United States Patent [19]

Yamauchi

[11] Patent Number: 4,483,230

[45] Date of Patent: Nov. 20, 1984

[54] ILLUMINATION LEVEL/MUSICAL TONE CONVERTER

[75] Inventor: Masamichi Yamauchi, Tanashi, Japan

[73] Assignee: Citizen Watch Company Limited, Tokyo, Japan

[21] Appl. No.: 514,986

[22] Filed: Jul. 18, 1983

[30] Foreign Application Priority Data

| | | | |
|---|---|---|---|
| Jul. 20, 1982 | [JP] | Japan | 57-126143 |
| Aug. 24, 1982 | [JP] | Japan | 57-145424 |
| Oct. 13, 1982 | [JP] | Japan | 57-179266 |

[51] Int. Cl.[3] ..... G10F 1/00

[52] U.S. Cl. ..... 84/1.03; 84/1.18; 84/1.28; 84/DIG. 19; 368/272

[58] Field of Search ..... 84/1.18, 1.28, 1.03, 84/DIG. 19, 464 R, 464 A, 1.01; 368/273, 274, 272

[56] References Cited

U.S. PATENT DOCUMENTS

| | | | |
|---|---|---|---|
| 3,787,602 | 1/1974 | Okudaira | 84/1.24 |
| 4,228,716 | 10/1980 | Linford | 84/1.28 |
| 4,344,346 | 8/1982 | Erickson et al. | 84/1.28 |

*Primary Examiner*—Forester W. Isen

*Attorney, Agent, or Firm*—Jordan and Hamburg

[57] ABSTRACT

An illumination level/musical tone converter is described which is suitable for incorporation into a miniature electronic device such as an electronic wristwatch, whereby the pitch of musical notes emitted by an acoustic output device can be varied as desired by the user varying the amount of illumination reaching a light sensor, e.g. by partially shading the sensor using a finger. Melodies can be composed in this way, and means can be provided for memorizing such melodies, which can be subsequently reproduced, e.g. to provide an audible alarm indication.

8 Claims, 9 Drawing Figures

ILLUMINATION LEVEL/MUSICAL TONE CONVERTER

BACKGROUND OF THE INVENTION

At the present time, there is a trend towards increasing the number of functions which are available with miniature electronic devices such as wristwatches or hand-held electronic games. Some types of wristwatch have been marketed which incorporate means for indicating the level of ambient illumination, for example, to enable the user to determine if there is sufficient illumination for such purposes as reading, etc. In addition, electronic timepieces which are provided with an alarm function are in some cases provided with read-only memory (ROM) means for storing data specifying a short sequency of musical tones, i.e. a melody, to be emitted as an audible alarm signal. However, the user will become tired of hearing the same melody repeated many times.

In view of these factors, the present invention provides an illumination level/musical tone converter which can be easily built into a miniature device such as an electronic wristwatch, and which enables the user to produce musical notes of desired pitch, simply by varying the amount of light which falls upon a light sensor. In this way, the user can compose melodies, play musical games, etc. In addition, means can be provided for memorizing melodies composed in this way, so that these can be reproduced at any desired time thereafter. In the case of a electronic alarm timepiece, such a stored melody can be emitted as an audible alarm signal, so that the user can at any time change the alarm signal with complete freedom. In this way, the danger of the user becoming bored with a constantly repeated audible alarm signal can be eliminated, and the market value of such an alarm timepiece can be enhanced.

SUMMARY OF THE DISCLOSURE

The present invention provides an illumination level/musical tone converter which can be incorporate into a miniature electronic device such as an electronic wristwatch, and which provides a display of the level of ambient illumination in the form of a plurality of illumination ranges, and which can be activated to emit a musical tone corresponding to each illumination range. The illumination level is detected by a light sensor, which produces activation power that is converted into digital signals, and then into a corresponding musical tone that is audibly emitted. The pitch of the musical tone thus emitted, which corresponds to the illumination level range within which the current illumination level falls, can be varied by partially shading the light sensor using a finger for example.

The musical tones produced in this way can be memorized by providing appropriate memory circuit means, and thereafter reproduced when desired. Since no external pushbuttons or other mechanical means are required to specify the tones, such an illumination level/musical tone converter can be readily implemented in very compact form, at low manufacturing cost. Means can also be provided for adjusting the conversion operation to reduce the amount of measurement error resulting from manufacturing variations in the characteristics of the light sensor.

BRIEF DESCRIPTION OF THE DRAWINGS

FIG. 1, 1A, and 1B form a block circuit diagram of a first embodiment of an illumination level/musical tone converter according to the present invention, which includes memory circuit means;

DESCRIPTION OF THE PREFERRED EMBODIMENTS

Figure 1A:
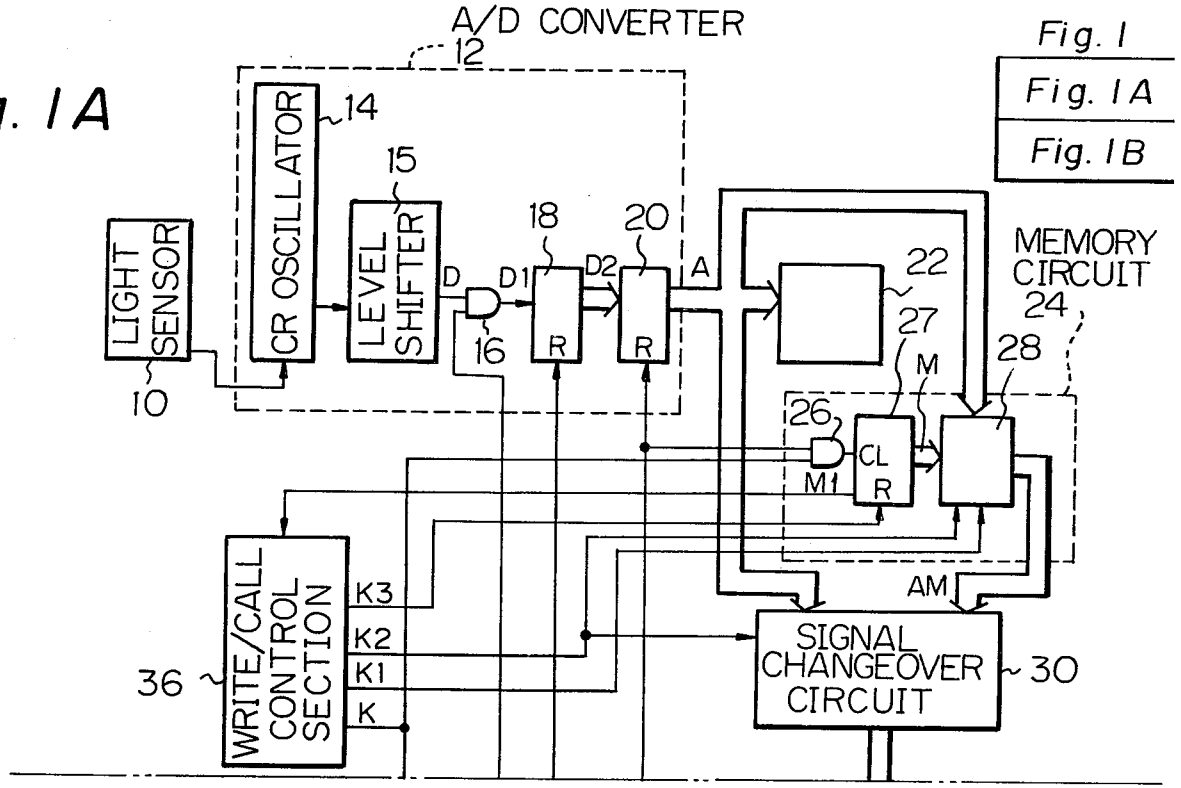
Figure 1B:
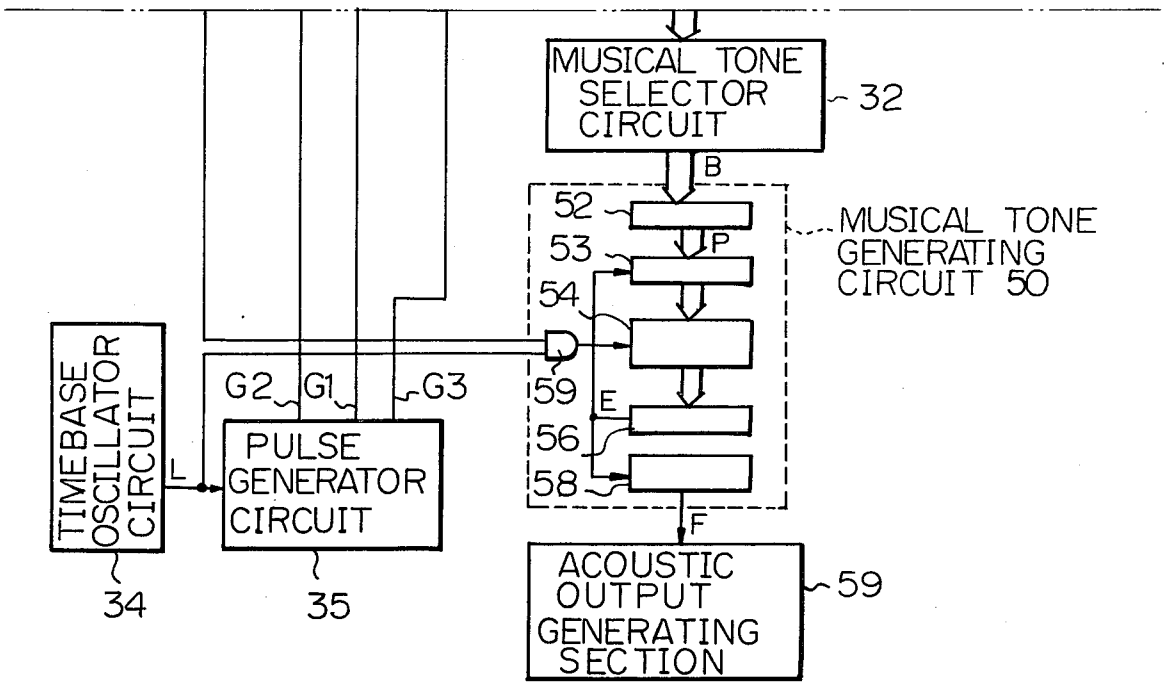

An embodiment of the present invention will now be described in detail, referring to the drawings. FIG. 1 is a block circuit diagram of an embodiment of an illumination level/musical tone converter according to the present invention. Numeral 10 denotes a light sensor, comprising a plurality of solar cells in this embodiment. Numeral 12 denotes an analog/digital converter, which comprises a CR oscillator circuit 14, a level shifter circuit 15, an AND gate 16, 6-bit counter 18 and a 6-bit latch circuit 20. CR oscillator circuit 14 operates from activation power C which is output from light sensor 10, as a power source, and incorporates a CMOS inverter (not shown in the drawings) which is used as an amplifier and whose ON resistance varies in accordance with changes in the activation power C. These variations in the ON resistance of the CMOS inverter produce corresponding changes in the time-constant of the capacitance-resistance timing network of CR oscillator circuit 14, to thereby determine the oscillation frequency. Thus, CR oscillator circuit 14 serves as a converter for producing an output signal whose frequency is controlled in accordance with the activation power C from light sensor 10. Since CR oscillator circuit 14 operates from the output voltage produced by light sensor 10 as a power source, the amplitude of the output signal produced will not be compatible with the other logic circuit elements, and so the output voltage from CR oscillator circuit 14 is transferred through a level shifter circuit 15, to be output as a corresponding signal D which varies between the appropriate logic level potentials. Signal D is input to AND gate 16, and is transferred through this AND gate to be applied as signal D1 to the clock terminal of counter 18 during the timing of a pulse of sampling signal G2, which controls AND gate 16. Latch circuit 20 serves to latch the 6 bits of the output signals D2 from counter 18, and to thereby produce a group of 6-bit digital signals, referred to hereinafter as illumination level digital signals A1 to A6, and collectively designated as illumination level digital signals A. These vary in accordance with predetermined ranges of illumination level as shown in Table 1.

Numeral 22 denotes a display section. This comprises a decoder for producing a decoding signal representing one of 9 different illumination level ranges in accordance with the contents of the 6 bits of illumination level digital signals A, a LCD drive circuit, and a LCD display device having 9 display segments for displaying 9 different ranges of illumination level. Since such LCD display devices and the drive circuitry required for these are very well known in the art, detailed description of these will be omitted from the drawings and specification.

TABLE 1

| Illumination level (Lux) | Illumination level digital signals A | | | | | |
|---|---|---|---|---|---|---|
| | A1 | A2 | A3 | A4 | A5 | A6 |
| 0 to 300 | x | 0 | 0 | 0 | 0 | 0 |
| 301 to 600 | x | 1 | 0 | 0 | 0 | 0 |
| 601 to 900 | x | 0 | 1 | 0 | 0 | 0 |
| 901 to 1200 | x | 1 | 1 | 0 | 0 | 0 |
| 1201 to 1500 | x | 0 | 0 | 1 | 0 | 0 |
| 1501 to 1800 | x | 1 | 0 | 1 | 0 | 0 |
| 1801 to 2100 | x | 0 | 1 | 1 | 0 | 0 |
| 2101 to 2400 | x | 1 | 1 | 1 | 0 | 0 |
| Over 2400 | x | x | x | x | x | 1 |

TABLE 2

| Illumination level digital signals A (Illumination level digital memory signals AM) | | | | | | Musical tone selection signals | | | | | | | | |
|---|---|---|---|---|---|---|---|---|---|---|---|---|---|---|
| A1 | A2 | A3 | A4 | A5 | A6 | | | | | | | | | |
| AM1 | AM2 | AM3 | AM4 | AM5 | AM6 | B1 | B2 | B3 | B4 | B5 | B6 | B7 | B8 | B9 |
| x | 0 | 0 | 0 | 0 | 0 | 1 | 0 | 0 | 0 | 0 | 0 | 0 | 0 | 0 |
| x | 1 | 0 | 0 | 0 | 0 | 0 | 1 | 0 | 0 | 0 | 0 | 0 | 0 | 0 |
| x | 0 | 1 | 0 | 0 | 0 | 0 | 0 | 1 | 0 | 0 | 0 | 0 | 0 | 0 |
| x | 1 | 1 | 0 | 0 | 0 | 0 | 0 | 0 | 1 | 0 | 0 | 0 | 0 | 0 |
| x | 0 | 0 | 1 | 0 | 0 | 0 | 0 | 0 | 0 | 1 | 0 | 0 | 0 | 0 |
| x | 1 | 0 | 1 | 0 | 0 | 0 | 0 | 0 | 0 | 0 | 1 | 0 | 0 | 0 |
| x | 0 | 1 | 1 | 0 | 0 | 0 | 0 | 0 | 0 | 0 | 0 | 1 | 0 | 0 |
| x | 1 | 1 | 1 | 0 | 0 | 0 | 0 | 0 | 0 | 0 | 0 | 0 | 1 | 0 |
| x | x | x | x | 1 | x | 0 | 0 | 0 | 0 | 0 | 0 | 0 | 0 | 1 |
| x | x | x | x | x | 1 | 0 | 0 | 0 | 0 | 0 | 0 | 0 | 0 | 1 |

A memory circuit 24 includes a 6-bit by 160 words random access memory circuit 27 (abbreviated in the following to RAM) which memorizes the illumination level digital signals A, and a counter circuit 27 which successively produces address signals M to designate addresses 0, 1, 2, . . . of memory locations in RAM 28 (into which the illumination level digital signals A are to be stored or from which they are to be called out) in response to successive clock pulses input to counter circuit 27 from an AND gate 26 which controls the supply of clock pulses to counter 27.

One of the input terms of AND gate 26 is connected to receive latch pulses G3 (described hereinafter), while the other input terminal is coupled to receive a write/-call signal K. Counter circuit 27 has the clock input terminal thereof coupled to the output terminal of AND gate 26, and has a reset input terminal R coupled to receive address reset pulses K3.

The 8-bit address signals M which are output from counter circuit 27 are supplied to the address inputs of RAM 28.

Each time counter circuit 27 counts to 160 pulses of latch pulses G3, a write/call termination signal N1 is output. If a write signal K1 (as described hereinafter) is at the high logic level (hereinafter abbreviated to H level), then RAM 28 will store the illumination level digital signals A at an address designated by address signals M.

If a call signal K2 (described hereinafter) is at the H level, then the illumination level digital memory signals AM which are stored at an address in RAM 28 designated by address signals M will be output.

Numeral 30 denotes a signal changeover circuit which receives as input the illumination level digital signals A1 to A6 from analog/digital converter 12, and the illumination level digital memory signals AM from RAM 28. This circuit serves to select either signals A1 to A6 or signals AM to be output therefrom, under the control of call signal K2. More specifically, when call signal K2 is at the H level, then the illumination level digital memory signals stored in RAM 28 are selected to be output, while if the call signal K2 is at the low logic level (hereinafter abbreviated to L level), then the illumination level digital signals A1 to A6 are selected to be output.

Figure 2:
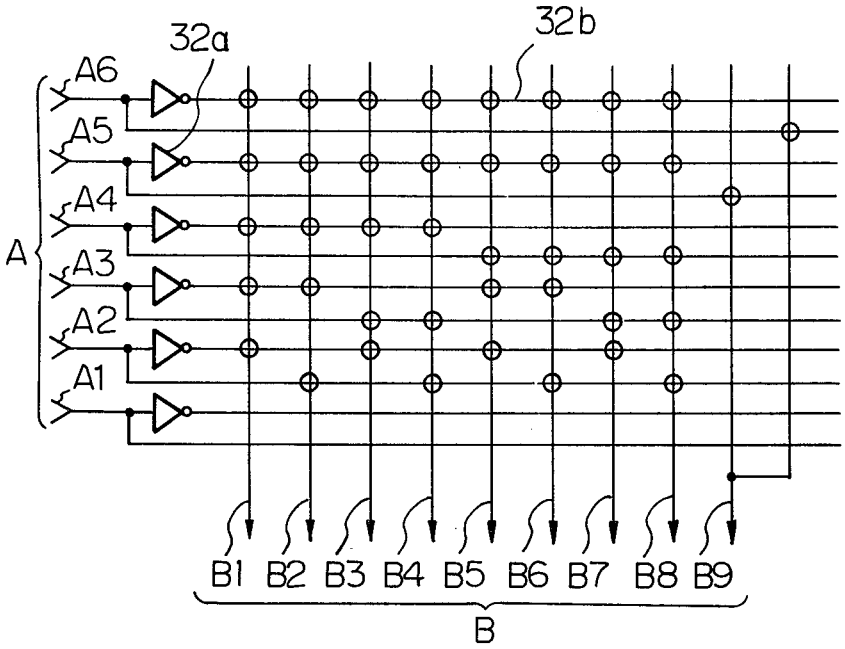
FIG. 2 is a circuit diagram of a musical tone selector circuit used in the embodiment of FIG. 1.

Numeral 32 denotes a musical tone selection circuit which serves to produce digital signals specifying musical tones, in response to input of digital signals representing an illumination level, received from the output of signal changeover circuit 30. FIG. 2 shows a specific embodiment of musical tone selection circuit 32. This comprises 6 inverters **32*a*, which respectively receive as inputs the illumination level digital signals A1 to A6 or the illumination level digital memory signals AM1 to AM6 (collectively designated as AM), whichever are selected to be output from signal changeover circuit, and a read-only memory (hereinafter abbreviated to ROM) 32*b* which receives as inputs the output signals from these 6 inverters (applied to a set of row conductors in the drawing) and the illumination level digital signals A1 to A6 or the illumination level digital memory signals AM1 to AM6 (applied to the set of column conductors shown in the drawing). As shown in Table 2, musical tone selection circuit 32 produces as outputs the musical tone selection signals B1 to B9 (collectively designated as musical tone selection signals B), in accordance with the state of the output signals from signal changeover circuit 30**.

In Table 1 and Table 2, "1" denotes the H logic level, while "0" denotes the L logic level, "x" denotes logical addition.

Figure 3:
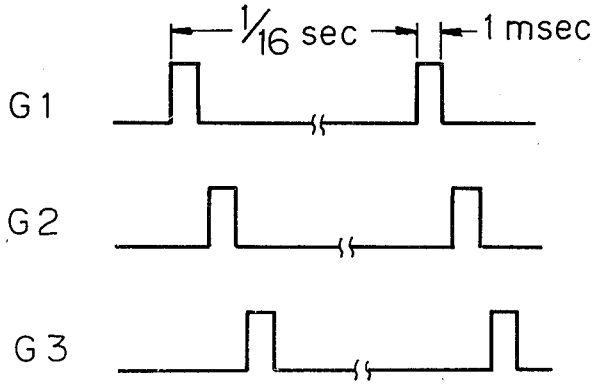
FIG. 3 is a timing diagram for illustrating control signal pulses used in the embodiment of FIG. 1.

Referring again to FIG. 1, numeral 34 denotes an oscillator circuit which produces a timebase signal L at a frequency of 32768 Hz. Numeral 35 denotes a pulse generator circuit which receives timebase signal L as input and produces three pulse train signals G1, G2 and G3, which differ in phase from one another as shown in FIG. 3. Pulse signal G1 comprises reset pulses for resetting counter circuit 18, pulse signal G2 comprises sampling pulses for transferring the illumination level digital signal D from CR oscillator circuit 14 through AND gate 16. Pulse signal G3 comprises latch pulses, which determine the timing at which count signals D2 from counter circuit 18 are stored in memory circuit 20.

Each of these pulse signals G1, G2 and G3 has a period of 1/16 seconds (i.e. a repetition frequency of 16 Hz), and a pulse width of approximately 1 msec, and comprises a periodic pulse train. This pulse width of each of sampling pulses G2 determines the number of pulses which are transferred to be counted by counter circuit 18, at any given frequency of oscillation of CR oscillator circuit 14.

Figure 4:
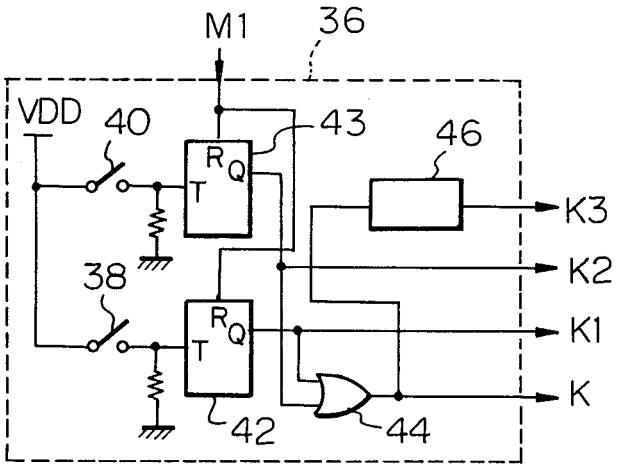
FIG. 4 is a circuit diagram of a write/call control section of the embodiment of FIG. 1.

Numeral 36 denotes a write/call control section, and a specific circuit configuration for this is shown in FIG. 4. Here, 38 and 40 denote externally actuatable switches, 42 denotes a T-type flip-flop (hereinafter abbreviated to T-FF) which receives as inputs the signals generated from switch 38 and produces as output a write signal K1. 40 denotes an OR gate which produces the logical sum of the write signal K1 and the call signal K2, to thereby produce a write/call signal K. 46 denotes a one-shot circuit which produces an address reset pulse K3, which has a very narrow pulse width and is generated at the instant when the write/call signal K changes from the L to the H level. This one-shot circuit comprises two D-type flip-flops and a gate circuit. When address reset pulse K3 is output (i.e. goes to the H level), counter 27 is reset.

When T-FF 42 and 43 are reset by a write/call termination signal M1 from counter circuit 27, then the write signal K1 and call signal K2 both go to the L level. When write/call signal K is at the H level, the musical tone generating circuit 50 is set in operation as described hereinafter.

The musical tone generating circuit 50 comprises a preset signal generating circuit 52 which produces a preset signal P for presetting down counters 54 (described hereinafter) respectively to specific preset values in accordance with the contents of musical tone selection signals B1 to B9 from musical tone selection circuit 32. It further comprises a preset timing circuit 53, consisting of a group of AND gates which transfer the preset signals P from preset signal generating circuit 52 to the output thereof in response to a sense signal E produced by a zero sensing circuit 59, described hereinafter. The musical tone generating section further comprises a down counter circuit 54 which consists of a set of 5 binary counter stages for counting signals output from an AND gate 59 (described hereinafter), with this counting being performed starting from an initial preset value. The latter is one of the preset values 16, 14, 13, . . . 8 that are shown in FIG. 3, and is input to down counter circuit 54 from preset signal generating circuit 52 in accordance with the states of the musical tone selection signals B1 to B9. The musical tone generating circuit 50 moreover comprises a duty ratio modifying circuit 58, which modifies the duty ratio of detection signal E from zero detection circuit 56 to a specific pulse width, and thereby produce an approximate musical tone frequency signal F.

TABLE 3

| Musical tone selection signals B | | | | | | | | | Preset | Approximate musical tone freq. | Musical |
|---|---|---|---|---|---|---|---|---|---|---|---|
| B1 | B2 | B3 | B4 | B5 | B6 | B7 | B8 | B9 | value | (KHz) | tone |
| 1 | 0 | 0 | 0 | 0 | 0 | 0 | 0 | 0 | 0 | 0 | rest |
| 0 | 1 | 0 | 0 | 0 | 0 | 0 | 0 | 0 | 16 | 2048 | doh |
| 0 | 0 | 1 | 0 | 0 | 0 | 0 | 0 | 0 | 14 | 2341 | re |
| 0 | 0 | 0 | 1 | 0 | 0 | 0 | 0 | 0 | 13 | 2521 | mi |
| 0 | 0 | 0 | 0 | 1 | 0 | 0 | 0 | 0 | 12 | 2731 | fah |
| 0 | 0 | 0 | 0 | 0 | 1 | 0 | 0 | 0 | 11 | 2979 | soh |
| 0 | 0 | 0 | 0 | 0 | 0 | 1 | 0 | 0 | 10 | 3277 | la |
| 0 | 0 | 0 | 0 | 0 | 0 | 0 | 1 | 0 | 9 | 3641 | ti |
| 0 | 0 | 0 | 0 | 0 | 0 | 0 | 0 | 1 | 8 | 4096 | doh |

Table 3 shows the relationships between the frequencies of the approximate musical tone frequency signals F which are output from duty ratio modifying circuit 50 in accordance with the preset values from down counter 54 and the corresponding musical tones.

Numeral 59 denotes an acoustic generating section for converting the approximate musical tone frequency signals F into audible tones. This comprises an acoustic driver circuit and an electroacoustic transducer such as a miniature loudspeaker (not shown in the drawings) which is driven by signals from the acoustic driver circuit.

The illumination level measurement operation of the circuit described above will now be described. First, it will be assumed that the level of incident illumination on light sensor 10 has a value of 2401 Lux or higher. If externally actuatable switch 40 of write/call control section 36 is actuated, the write signal K1 will go to the H level, and as a result the write/call signal K will go to the H level. In this condition, if the user wishes to input the musical tone "doh", this can be done by the user partially shading light sensor 10 (using the palm of the hand or a finger) to reduce the level of light incident on light sensor 10 to within the range 301 to 600 Lux. When this is done, CR oscillator circuit 14 will operate from a level of activation power C that is determined by an illumination in the range 301 to 600 Lux incident on light sensor 10, and a corresponding frequency signal D will be output.

At this time, counter 18 is in the reset state, as a result of a previously generated H level pulse G1 from pulse generating circuit 35. When pulse G2 from pulse generating circuit 35 subsequently goes from the L to the H level, then AND gate 16 will transfer frequency signal D from CR oscillator circuit 14 to be counted by counter circuit 18 during an interval of approximately 1 msec, whose duration is determined by that pulse G2. When this interval is terminated, the count contents of counter circuit 18 (represented by the 6-bit output signals designated as D2), are stored in latch circuit 20 when pulse signal G3 from pulse generator circuit 35 goes from the H to the L level.

Thus, as can be understood from Table 1, latch circuit 20 will output the illumination level digital signals A1 to A6 at the logic levels (X, 1, 0, 0, 0, 0) respectively. At the same time, if write signal K1 is at the H level, then RAM 28 of memory circuit 24 is set in the write-in state and the address preset pulse K3 causes counter circuit 27 to produce address signals M which designate address 0. As a result, the contents of illumination level digital signals A1 to A6 become stored in address 0 of RAM 28.

As a result of the illumination level digital signals A1 to A6 being input to display section 22, the segment of display section 22 which indicates the illumination level range 0 to 300 Lux and also the segment which indicates the illumination level range 301 to 600 Lux are both turned ON. This indicates in a cumulative display manner that the illumination level is in the range 301 to 600 Lux. At the same time, the characters "doh" are displayed near the display segment indicating the 301 to 600 Lux illumination level, thereby visibly indicating that the musical note "doh" has been input, and thereby provides visible confirmation.

In addition, since the call signal K2 is output at the L level, the illumination level digital signals A1 to A6 are output from signal changeover circuit 30.

Thus, as shown in Table 2, the musical tone selection signals B1 to B9 are output as (0, 1, 0, 0, 0, 0, 0, 0, 0) respectively, in accordance with the output signals from musical tone selection circuit 32, based on the states of the illumination level digital signals A1 to A6.

Preset signals P from preset signal generating circuit 52 are output at this time, in accordance with the states of signals B1 to B9. When the detection signal E from zero detection circuit 56 goes to the H level, preset signals P are transferred through timing circuit 53 and are preset into down counter 54 as the preset value 16.

At the instant when preset of down counter 54 occurs, the sense signal E of zero detection circuit 56 goes to the L level, whereby preset timing circuit 53 inhibits transfer of the preset signals P and in addition the 32768 Hz signal L which is output from AND gate 59 starts to be counted by down counter circuit 54 starting from the preset value 16 as an initial count value.

When the contents of down counter 54 reach zero, then detection signal E from zero detection circuit 50 goes to the H level, whereupon if there has been no change in the area of light sensor 10 that is shaded, the preset signals P are once more transferred through preset timing circuit 56 into down counter circuit 54 to again preset an initial count value of 16 therein. The sequence of operations described above are then repeated.

As a result of successive repetitions of this sequence of operations, the repetition frequency of detection signal E from zero detection circuit 56 becomes equal to the frequency of timebase signal L output from AND gate 59 divided by the preset value 16, i.e. has a value of 2048 Hz.

This 2048 Hz detection signal E is input to duty ratio modifying circuit 58 and is thereby converted to an approximate musical tone frequency signal F at a frequency of 2048 Hz but having a specific pulse width. In this way, acoustic generating section 59 generates the musical tone "doh" in response to input of the approximate musical tone frequency signal F.

If now the user wishes to input another note in succession to the note "doh", for example the note "re", then this can be performed by shading an appropriate part of the illumination incident on light sensor 10, using the palm of the hand or a finger, i.e. such as to provide a level of incident light in the range 601 to 900 Lux.

To do this, it is necessary to reduce the area of the surface of light sensor 10 that is shaded, by comparison with the area that was shaded in the case of input of the note "doh". When this shading operation is performed, then CR oscillator circuit 14 begins to operate from activation power C as a power source, whose level is determined in accordance with an illumination level in the range 601 to 900 Lux falling on light sensor 10. A corresponding frequency signal D is output.

Thus, after counter 18 has been set in the reset state by pulse G1, the next G2 pulse acts to transfer frequency signal D through AND gate 16, to be counted by counter 18 as frequency signal D1.

On the falling edge of the next G3 pulse (i.e. when the next G3 pulse goes from the H to the L level), latch circuit 20 memorizes output signals D2 from counter circuit 18, and these are transferred as illumination level digital signals A to display section 22, and through signal changeover circuit 30 to musical tone selection circuit 32.

As a result, the display segment of display section 22 which indicates the 0 to 300 Lux illumination level is set in the ON state, together with a 301 to 600 Lux illumination level indicating segment, and the 601 to 900 Lux illumination level indicating segment, thereby indicating that the illumination level is in the range 601 to 900 Lux. At the same time, a visible confirmation is provided that the tone "re" has been input, by the characters "re" being displayed beside the segment that indicates the 601 to 900 Lux illumination level.

Furthermore at this time, illumination level digital signals A (i.e. signals A1 to A6) which are transferred through signal changeover circuit 30 to be input to musical tone selection circuit 32, cause musical tone selection signals B1 to B9 to be output at the logic levels (0, 0, 1, 0, 0, 0, 0, 0, 0) as shown in FIG. 2. Accompanying preset signals P are output from preset signal generating circuit 52.

Thus, when detection signal E from zero detection circuit 56 goes to the H level, the preset signals P are transferred through preset timing circuit 53 to be preset into down counter circuit 54 as a preset value 14.

At the instant when this value is preset into down counter circuit 54, detection signal E from zero detection circuit 56 goes to the L level, thereby inhibiting transfer of the preset signals P by preset timing circuit 53, and also initiating down counting of the 32768 Hz signal which is output from AND gate 59 by down counter circuit 54 (starting from an initial count value of 14).

When the count contents of down counter circuit 54 reach zero, the detection signal E from zero detection circuit 56 goes to the H level, so that the preset signals P are again transferred through preset timing circuit 53 to be preset into down counter circuit 54. Thereafter, the sequence of events described above is repetitively performed so long as the shaded area of light sensor 10 remains unchanged.

In this case, the repetition frequency of the detection signal E from zero detection circuit 56 is again equal to the frequency of timebase signal L that is output from AND gate 59 (i.e. 32768 Hz) divided by the preset value, giving a frequency value of 2341 Hz. This 2341 Hz detection signal E is converted to approximate musical tone frequency signals F at a frequency of 2341 Hz and having a specific pulse width, whereby the musical tone "re" is emitted by acoustic generating section 59.

In this way, the user can designate input of any of the notes of the musical scale shown in FIG. 3 (which in this embodiment is limited to a single octave), by combinations of stepwise increments or decrements of shading of light sensor 10. The range of these changes in shading extend from the condition in which light sensor 10 is entirely shaded to a condition in which it is completely unshaded. In this way, the user can compose melodies, can play note-finding games, etc.

For each of the shading operations described above, counter 27 of memory circuit 24 counts pulses G3 from pulse generator circuit 35, changes the contents of address signals M accordingly, and stores the 6 bits of illumination level digital signals A in an address of RAM 28 designated by address signals M.

After 10 seconds have elapsed (i.e. after 160 pulses of signal G3 from pulse generator circuit 35 have been transferred to counter circuit 27 of memory circuit 24), a write/call termination signal M1 is output from counter circuit 27, and this sets T-FF 7c of write/call control section 36 into the reset state (i.e. sets write signal K1 at the L level).

In addition, write/call signal K goes to the L level, so that AND gate 59 is inhibited. As a result, output of approximate musical tone frequency signals F from approximate musical tone generating circuit 50 is inhibited, and audible output from acoustic generating section 59 is terminated. At the same time, AND gate 26 of memory circuit 24 is inhibited and write-in to RAM 28 of memory circuit 10 is halted.

The operation of the circuit after the above operations have been completed will now be described, for the case in which the memorized illumination level digital memory signals AM in RAM 28 of memory circuit 24 are called out, to generate notes and produce acoustic tone outputs.

When external switch 40 of write/call control section 36 is actuated, the call signal K2 from T-FF 43 goes to the H level. When this occurs, counter circuit 27 of memory circuit 24 is reset by address reset pulse K3 from one-shot circuit 46, so that address signals M are set to zero.

At this time, since call signal K2 is at the H level, RAM 28 of memory circuit 24 enters the call-out state, and signal changeover circuit 30 is set in the condition to selectively transfer the illumination level digital signals AM from RAM 28.

In addition, as a result of the write/call signal K being at the H level, acoustic generating section 59 enters the "acoustic output enabled" state, while AND gate 26 of memory circuit 24 is enabled. Counter circuit 27 of memory circuit 24 then begins counting in response to pulses G3 from pulse generator circuit 35, and the address signals M successively change to the values (0, 1, 2, . . . ).

At the same time, the illumination level digital memory signals AM stored at the address of RAM 28 designated by address signals M are transferred as the 6-bit signals AM1 to AM6 through signal changeover circuit 30, and thereafter are used as musical tone signals which are reproduced as audible tones by acoustic generating section 59.

It should be noted that instead of controlling the call-out of a tone sequence from RAM 28 of memory circuit 24 by actuation of a switch, it is equally possible to control this call-out by a coincidence signal generated by a coincidence detection circuit in an alarm timepiece, produced when the contents of a timekeeping counter reach coincidence with the contents of an alarm memory circuit. In this way, the user can freely select any melody to be audibly emitted as an alarm signal.

Figure 5:
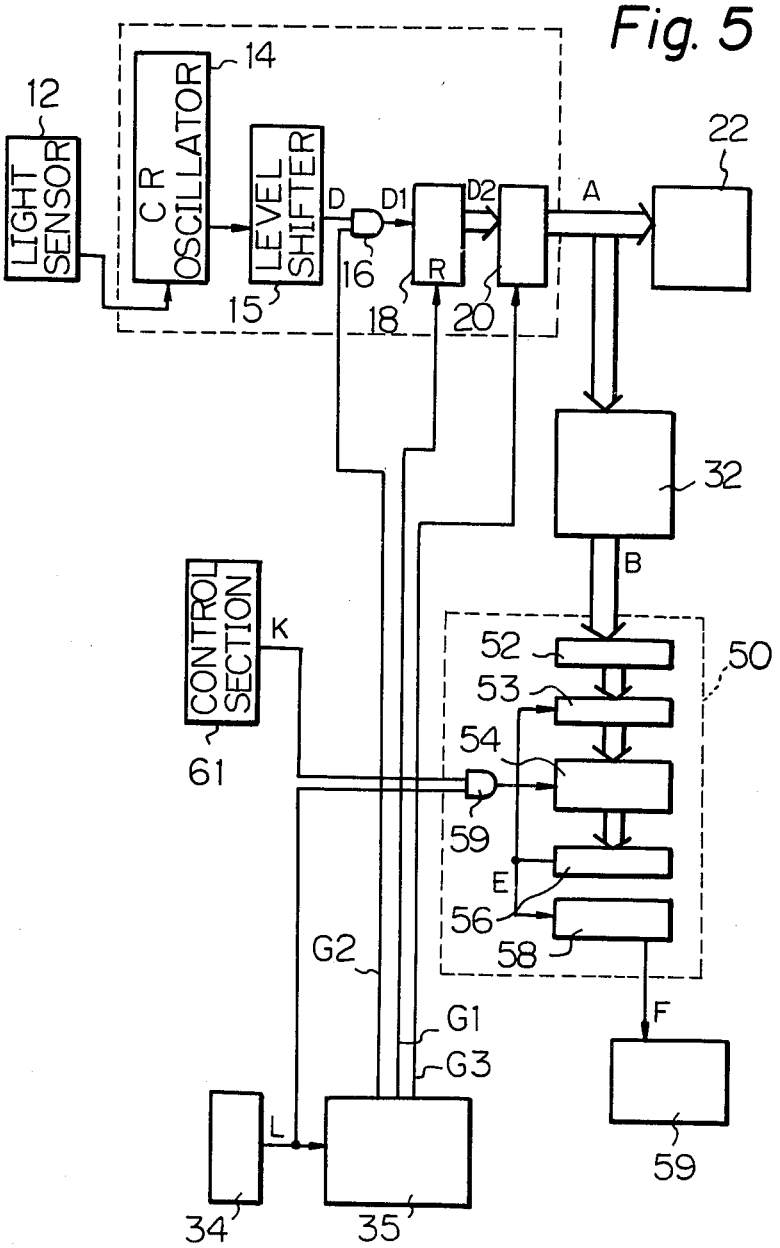
FIG. 5 is a block circuit diagram of a second embodiment of an illumination level/musical tone converter according to the present invention.

FIG. 5 shows another embodiment of the present invention. This is basically similar to the first embodiment described above, but does not incorporate means for memorizing a sequence of musical tones such as is provided by memory circuit 24. A write control section 61 includes externally actuatable switches, and these can be actuated to produce a signal K, at the H level. When this is done, AND gate 59 in musical tone generating circuit 50 is enabled, as in the first embodiment, so that high-frequency pulses from timebase oscillator circuit 34 are transferred to be counted by down counter circuit 54. In this condition, the frequency of the output signal F from musical tone generating circuit 50 which is input to acoustic output generating section 59 will be determined by the frequency of oscillation of CR oscillator circuit 14, as in the first embodiment, so that the user can produce musical notes of a desired frequency by varying the degree of shading of light sensor 12.

An illumination level/musical tone converter according to the present invention such as that shown in FIG. 5 can be incorporated for example into an electronic wristwatch, whereby a display of the level of ambient illumination is provided by display device 22 while in addition the user can at any time find amusement by playing melodies, simply by varying the amount of light reaching light sensor 12 by shading the sensor with a finger. In this way, the market appeal of a device such as a wristwatch can be greatly enhanced, with a negligible increase in manufacturing cost.

A solar battery of the type suitable for use as light sensor 10 generally displays manufacturing deviations in the characteristics, (and hence in the level of output current which can be supplied to drive a load at any given level of incident illumination) which can be of the order of 30%. Thus, if the frequency of oscillation of CR oscillator circuit 14 is designated as F and the output voltage supplied by light sensor 10 to operate CR oscillator circuit 14 is designated as V, then if the level of current which will be supplied to CR oscillator circuit 14 from light sensor 10 is designated as I, the following is true:

$$I \propto F \cdot V \tag{1}$$

There is a proportional relationship between voltage V and frequency F, i.e.:

$$F \propto V \tag{2}$$

Thus, from equations (1) and (2), the relationships between frequency F and current I is given as:

$$F \propto \sqrt{I} \tag{3}$$

Accordingly, if the deviations in the value of current I supplied from light sensor 10 is assumed to be 30%, then this will result in a corresponding deviation of approximately 14% in the frequency F. This will result in an error in the displayed light level and in the acoustic output signal. However this error can be eliminated by suitably adjusting the pulse width of the sampling pulses which sample the output signal from the CR oscillator circuit, e.g. by adjusting the pulse width of signal G2 in the embodiment of FIG. 1.

More specifically, the maximum amount of error of the displayed and acoustically generated output indications within each illumination range can be held within a small amount, by a relatively coarse degree of adjustment of the pulse width of the sampling signals. Another embodiment of the present invention will now be described in which such adjustment means are provided.

Figure 6:
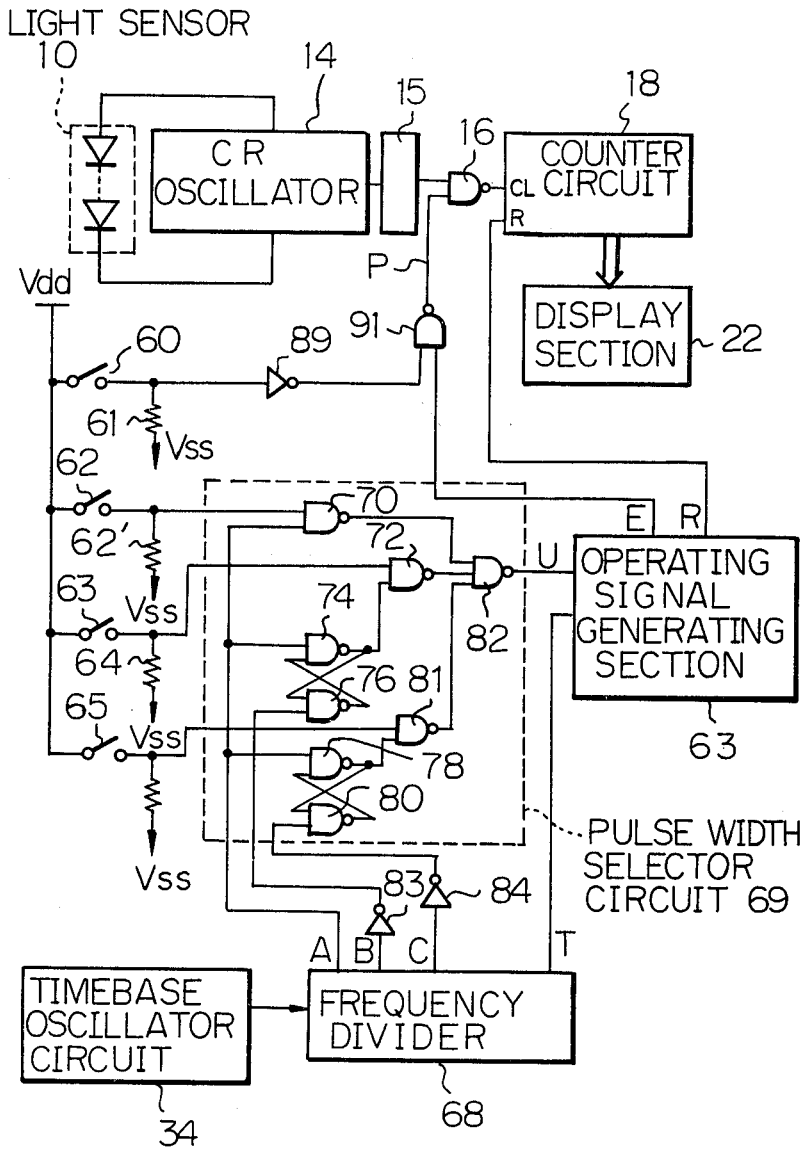
FIG. 6 is a block circuit diagram of a third embodiment of an illumination level/musical tone converter according to the present invention, in which means are provided for adjustment of the pulse width of sampling pulses used for illumination level/musical tone data conversion.

A simplified block circuit diagram of this embodiment is shown in FIG. 6. Here, numeral 10 denotes a light sensor, comprising a solar battery, while numeral 14 denotes a CR oscillator circuit which operates from light sensor 10 as a power source, as in the previous embodiments, with the output signal from CR oscillator circuit 14 being transferred through a level-shifter 15 to be input to a NAND gate 16. Numeral 18 denotes a counter circuit which receives the output from NAND gate 82 at a clock input terminal, and numeral 22 denotes a display section comprising a decoder/driver circuit and LCD display elements.

Sampling pulses P, produced as described hereinafter, are applied from the output of a NAND gate 91 to the other input of NAND gate 16.

If the number of pulses of the output signal from NAND gate 16 input to counter circuit 18 is designated as N, the frequency of the output signal from CR oscillator circuit 14 is designated as F, the pulse width of the sampling pulses P (i.e. the time for whch each pulse is at the H level) is designated as T, then:

$$N=F\cdot T \tag{4}$$

Thus, by adjusting the pulse width T in accordance with the value of frequency F, the number of pulses N which are input to counter circuit 18 can be set such as to reduce the amount of error in the value of N to as low a degree as is desired.

Numeral 89 denotes an inverter, having an input coupled to a pull-down resistor 61 and to an externally actuatable switch 60. The output of inverter 89 is coupled to one input of NAND gate 91. The other input of NAND gate 91 is coupled to receive a signal E, referred to in the following as a basic sampling signal, which is produced by an operating signal generating circuit 23. A reset signal R is also output from operating signal generating circuit 23, and is input to the reset terminal R of counter circuit 18.

Numerals 70 to 82 denote NAND gates which constitute a pulse width selector circuit 69. An externally actuatable switch 62, with a pull-down resistor, is coupled to one input of NAND gate 70, while a 512 Hz signal A produced by a frequency divider circuit 68 is applied to the other input terminal. The output of NAND gate 70 is coupled to one input of NAND gate 82. NAND gates 74 and 76 are connected with one input of each coupled to the output of the other, to form a latch circuit. The other input of NAND gate 74 is coupled to receive signal A. The other input of NAND gate 76 is coupled to receive a 409 Hz signal B which is produced by frequency divider circuit 68. The output of NAND gate 74 is connected to one of the inputs of NAND gate 72, while the other input of NAND gate 72 is coupled to a pull-down resistor and externally actuatable switch 63. The output of NAND gate 72 is coupled to the other input of NAND gate 82. NAND gates 78 and 80 each have the output thereof connected to an input term of the other, to form a latch circuit. The other input of NAND gate 78 is coupled to receive signal A, while the other input of NAND gate 80 is coupled to receive an 819 Hz signal C which is produced by frequency divider circuit 68, applied through an inverter 84. The output of NAND gate 78 is coupled to an input of NAND gate 81, while the other input of NAND gate 78 is coupled to a pull-down resistor and externally actuatable switch 65. The output of NAND gate 81 is coupled to an input of NAND gate 82, while the output of NAND gate 82 is input to operating signal generating circuit 63 as a clock signal which determines the pulse width of basic sampling signal E.

The basic sampling signal E comprises a train of pulses whose repetition period is that of a 16 Hz signal T which is output by frequency divider circuit 68, and whose pulse width is determined by the duty ratio of the output signal from NAND gate 82 of pulse width selector circuit 69, which will be designated as U. Numeral 34 is a timebase oscillator circuit which produces an output signal having a frequency of 32768 KHz. This is input as a clock signal to frequency divider circuit 68.

As described for the previous embodiments, the frequency of oscillation of CR oscillator circuit 14 is determined by the activation power produced by light sensor 10. If switch 60 is closed, then the output of NAND gate 91 goes to the H level during each pulse of basic sampling signal E, so that NAND gate 16 becomes enabled and the output signal from CR oscillator circuit 14 is transferred through NAND gate 82.

If switches 60, 63 and 65 are in the open state, while SW 62 is closed, then NAND gate 70 will be enabled, and the 512 Hz signal A will be transferred through NAND gates 70 and 82 to be input as a clock signal to operating signal generating circuit 63. The operating signal generating circuit 23 will thereby produce basic sampling signal E as a train of pulses having a pulse width of approximately 0.976 msec (more precisely, $1/512\times2$ seconds), and a period of 1/16 second. The basic sampling signal E is transferred through NAND gate 91 and output therefrom as sampling signal P, which successively enable NAND gate 82. Immediately prior to each pulse sampling signal P, counter circuit 18 is reset by reset signal R, and thereafter NAND gate 82 is enabled to pass pulses from CR oscillator circuit 14 at a frequency F, for approximately 0.976 msec, to be counted by counter circuit 18. The count data from counter circuit 18 is displayed as an illumination level by display section 22.

If now switches 62 and 65 are open and 63 is closed, then NAND gate 72 will be enabled. In this case, basic sampling signal E is output with a period of 1/16 second and a pulse width approximately 12.5% shorter (i.e. equal to approximately 0.122 msec) than in the case when NAND gate 70 was opened by 62 being closed. Similarly, when 60 and 63 are open and 63 is closed, then NAND gate 81 becomes enabled, and as a result the basic sampling signal E is output from operating signal generating circuit 23 with a period of 1/16 second and a pulse width which is 62% shorter than in the case when NAND gate 70 is enabled (i.e. becomes equal to approximately 0.061 msec).

As described previously, there can be a deviation in the characteristics of light sensor 10 of the order of 30%, which corresponds to a variation in the frequency of oscillation of CR oscillator circuit 14 of the order of 14%. If the frequency of oscillation is measured at some specific illumination level with switch 60 closed, then adjustment for the deviation in the count value in counter circuit 18 resulting from a manufacturing deviation in the characteristics of light sensor 10 can be performed, (using a predetermined illumination level incident on light sensor 10) to bring the amount of error in the measured illumination level to within a range of approximately +3%, by closing switch 60, coupling count measuring means to the output of NAND gate 82 or to counter circuit 18, and selectively closing one from among the switches 62 to 65 such as to make the number of pulses output from NAND gate 82 during each pulse of sampling signal P substantially equal to the correct number of pulses corresponding to the illumination level incident on light sensor 10.

Figure 7:
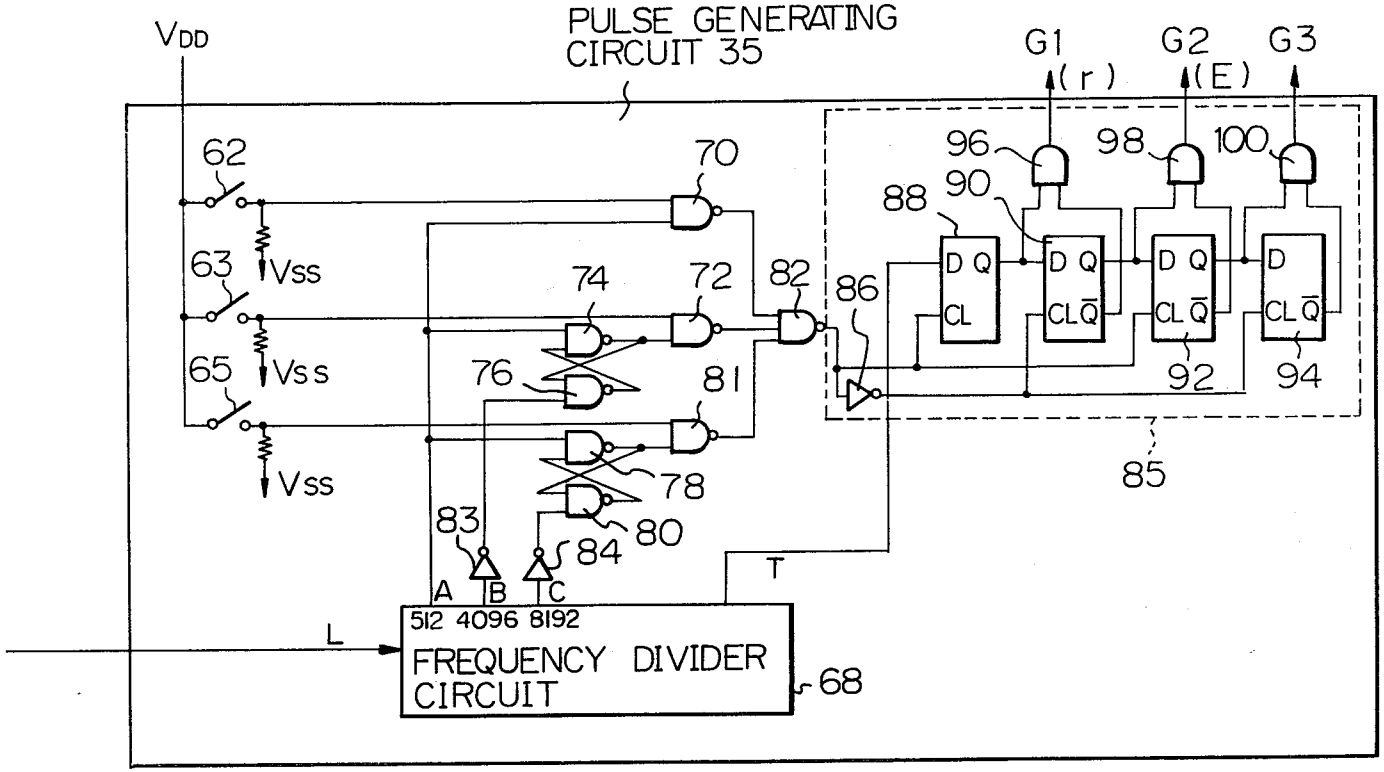
FIG. 7 is a circuit diagram of a modified form of a pulse generator circuit of the embodiment of FIG. 1 and FIG. 1, for enabling adjustment of the pulse width of sampling pulses used for illumination level/musical tone data conversion.

It is equally possible to apply such a method of adjustment of the sampling pulse width to the first two embodiments of the present invention described above with reference to FIG. 1 and FIG. 5, by appropriate modifications to pulse generating circuit 35. An embodiment of a simple circuit for accomplishing this is shown in FIG. 7. Here, NAND gates 70 to 82, frequency divider circuit 68, and switches 62 to 65 all have exactly the same functions and are interconnected in the same way as in the embodiment of FIG. 6, so that further description will be omitted. As described for the embodiment of FIG. 6, the duty ratio of pulses at a relatively high frequency output from NAND gate 82 can be varied by suitably setting appropriate ones of switches 62 to 65 in the open and closed states. Numeral 85 denotes a circuit which receives the output pulses from NAND gate 82 with these being applied directly to the clock input terminals of data-type flip-flops (hereinafter referred to as D-FFs) 88 and 92, and applied in inverted form from the output of an inverter 86 to the clock input terminals of D-FFs 80 and 84. The output and data input terminals of D-FFs 88 to 94 are connected in cascade, as shown, with a 16 Hz pulse train signal T being applied to the data input terminal of D-FF 88 from frequency divider circuit 68. The Q and Q outputs of D-FFs 88 and 90 are connected respectively to inputs of an AND gate 96, those of D-FF 90 and 92 to inputs of AND gate 98, and those of D-FFs 92 and 94 to inputs of an AND gate 100, It will be apparent that pulses G1, G2 and G3 will be generated successively once every 1/16 seconds, with the pulse width of these pulses being determined by the duty ratio of the output signal from NAND gate 82. Thus, the pulse width of the sampling pulses G2 can be varied to reduce the amount of error in the measured illumination level, as described for the embodiment of FIG. 6.

The amount of light falling on light sensor 10 will vary in accordance with a number of conditions, such as the ambient illumination and shade, the state of lighting within a room, and the speed with which the user's palm or finger is passed over the light sensor. Thus, in order to specify input of a particular note it will be necessary for the user to vary the area of light sensor 10 that is shaded, in accordance with these changes in operating conditions, so that a certain degree of technical skill will be required. Such an illumination meter equipped illumination level/musical tone converter can also be used as an interesting type of game.

Thus as described in the above, the present invention enables an illumination level meter to be produced which is provided with an illumination level/musical tone converter, having a simple circuit configuration and which enables any desired melody to be composed. Musical notes to be input are specified by an incident light shading operation, so that no actuations of keys or pushbuttons, such as are required in the prior art, are necessary. It is also possible to implement the invention such that a certain amount of skill is necessary to compose a melody, so that the invention can also be utilized as a highly interesting game element.

Although the present invention has been described in the above with reference to specific embodiments, it should be noted that various changes and modifications to these embodiments may be envisaged, which fall within the scope claimed for the present invention as set out in the appended claims.

What is claimed is:

1. An illumination level/musical tone converter, comprising:

a timebase oscillator circuit for producing a timebase signal;

a light sensor for producing activation power in response to a level of illumination incident thereon;

an analog/digital converter circuit which operates at least partially from said activation power as a source of power, and generates illumination level digital signals in accordance with the level of said activation power;

a pulse generating circuit coupled to receive said timebase signal and producing control signals to control the operation of said analog/digital converter circuit;

a musical tone selection circuit for producing musical tone selection signals in accordance with said illumintion level digital signals from said analog/digital converter circuit;

a musical tone generating circuit for producing approximate musical tone frequency signals in accordance with said musical tone selection signals from said musical tone selection circuit; and an acoustic output device coupled to receive said approximate musical tone frequency signals from said musical tone generating circuit, and responsive thereto for producing corresponding audible musical tones.

2. An illumination level/musical tone converter according to claim 1, in which said analog/digital converter circuit comprises:

an illumination level sensing oscillator circuit having a predetermined relationship between the operating power supplied thereto and the frequency of an oscillation signal produced therefrom, which operates directly from said activation power of said light sensor as a power supply;

a level shifter circuit coupled to output terminals of said illumination level sensing oscillator circuit;

a gate circuit which receives as one input thereto the oscillation signal from said illumination level sensing oscillator circuit transferred through said level shifter circuit, for transferring therethrough said oscillation signal during predetermined time intervals;

a counter circuit for counting pulses of an output signal from said gate circuit; and a latch circuit for memorizing the count contents of said counter circuit and for producing as outputs said count contents as said illumination level digital signals.

3. An illumination level/musical tone converter according to claim 1, in which said musical tone selection circuit comprises:

a plurality of inverters which receive as input signals said illumination level digital signals from said latch circuit; and a read-only memory circuit which produces said musical tone selection signals in response to said illumination level digital signals from said latch circuit and inverted illumination level digital signals produced by said plurality of inverters.

4. An illumination level/musical tone converter according to claim 1, in which said musical tone generating circuit comprises:

a preset signal generating circuit for producing preset signals in accordance with the states of the musical tone selection signals from said musical tone selection circuit;

a down-counter circuit which is preset to a specific value determined by said preset signals;

a zero detection circuit for sensing when the count contents of said down counter circuit reach zero and for producing a detection signal pulse each time said zero condition is attained;

a duty ratio modifying circuit for converting the pulse width of said zero detection signal pulses output from said zero detection circuit, to thereby produce a train of pulses having a specific duty ratio, which are output as said approximate musical tone frequency signals;

a gate circuit for controlling the application of signals to a count input terminal of said down counter circuit; and a preset timing circuit coupled between said preset signal generating circuit and said down counter circuit, for controlling the transfer of said preset signals at timings determined by said detection signal pulses from said zero detection circuit.

5. An illumination level/musical tone converter according to claim 2, in which said pulse generating circuit comprises:

a frequency divider circuit coupled to receive as input said timebase signal from said timebase oscillator circuit; and a signal generating circuit coupled to receive a plurality of frequency-divided signals of different frequencies from said frequency divider circuit and responsive thereto for producing three trains of control pulses mutually differing in phase, said trains of control pulses respectively comprising reset pulses to reset said counter circuit of said analog/digital converter circuit, sampling pulses for controlling the durations of time intervals during which said gate circuit of said analog/digital converter circuit is enabled to transfer said level-shifted oscillation signal therethrough, and latch pulses which generate the timings at which latching operations of said latch circuit in said analog/-digital converter circuit are performed.

6. An illumination level/musical tone converter according to claim 5, and further comprising pulse width selection circuit means coupled to said pulse generating circuit for controlling the pulse width of said sampling pulses, and selection setting switch means actuatable for controlling the operation of said pulse width selection circuit means to set said pulse width to a desired value.

7. An illumination level/musical tone converter, comprising:

a timebase oscillator circuit for producing a timebase signal;

a light sensor for producing an activation power in accordance with the level of illumination incident thereon;

an analog/digital converter circuit which receives said activation power as at least a part of the supply power for operation thereof and produces illumination level digital signals in accordance with the level of said activation power;

a pulse generating circuit coupled to receive said timebase signal and responsive thereto for producing control signals to control the operation of said analog/digital converter circuit;

a memory circuit coupled to receive as inputs to be memorized therein said illumination level digital signals from said analog/digital converter circuit;

a write/call control circuit for controlling write-in of data to said memory circuit and call-out of stored data from said memory circuit;

a signal changeover circuit for receiving as inputs the output signals from said memory circuit and said illumination level digital signals from said analog/-digital converter circuit and for selecting either said illumination level digital signals or said memory circuit output signals to be output therefrom;

a musical tone selection circuit for producing musical tone selection signals in accordance with the output signals from said signal changeover circuit;

a musical tone generating circuit for producing approximate musical tone frequency signals in accordance with said musical tone selection signals from said musical tone selection circuit; and an acoustic output device for producing audible musical tones in accordance with said approximate musical tone frequency signals from said musical tone generating circuit.

8. An illumination level/musical tone converter according to claim 7, in which said memory circuit comprises:

a random-access memory which receives said illumination level digital signals from said analog/digital converter circuit as input signals;

an address counter for specifying addresses in said random access memory; and a gate circuit for receiving latch pulses produced from said pulse generating circuit and write/call signals from said write/call control circuit as input signals, and for supplying count input signals to be counted by said address counter circuit.

* * * * *